US010378475B2

(12) United States Patent
Denk

(10) Patent No.: US 10,378,475 B2
(45) Date of Patent: Aug. 13, 2019

(54) METHOD FOR DETERMINING A REFERENCE CURRENT VALUE FOR ACTUATING A FUEL INJECTOR

(71) Applicant: Continental Automotive GmbH, Hannover (DE)

(72) Inventor: Frank Denk, Obertraubling (DE)

(73) Assignee: CPT Group GmbH, Hannover (DE)

( * ) Notice: Subject to any disclaimer, the term of this patent is extended or adjusted under 35 U.S.C. 154(b) by 0 days.

(21) Appl. No.: 15/580,504

(22) PCT Filed: Apr. 14, 2016

(86) PCT No.: PCT/EP2016/058188
§ 371 (c)(1),
(2) Date: Dec. 7, 2017

(87) PCT Pub. No.: WO2016/198184
PCT Pub. Date: Dec. 15, 2016

(65) Prior Publication Data

US 2018/0156153 A1 Jun. 7, 2018

(30) Foreign Application Priority Data

Jun. 12, 2015 (DE) ..... 10 2015 210 794

(51) Int. Cl.
*F02D 41/24* (2006.01)
*F02D 41/20* (2006.01)

(52) U.S. Cl.
CPC ..... *F02D 41/2467* (2013.01); *F02D 41/20* (2013.01); *F02D 2041/2003* (2013.01);
(Continued)

(58) Field of Classification Search
CPC .. F02D 41/20; F02D 41/2013; F02D 41/2055; F02D 41/24; F02D 41/2467;
(Continued)

(56) References Cited

U.S. PATENT DOCUMENTS 5,402,760 A * 4/1995 Takeuchi ..... F02D 41/20 123/300
6,476,599 B1 11/2002 Czimmek et al.
(Continued)

FOREIGN PATENT DOCUMENTS

DE 60030611 T2 9/2007
DE 102010063009 A1 6/2012
(Continued)

OTHER PUBLICATIONS

International Search Report and Written Opinion dated Jul. 7, 2016 from corresponding International patent application PCT/EP2016/058188.
(Continued)

*Primary Examiner* — Hung Q Nguyen
*Assistant Examiner* — Johnny H Hoang

(57) ABSTRACT

A method for determining a reference current value for actuating a fuel injector, comprising a solenoid drive, for an internal combustion engine of a motor vehicle is described. The method comprises the following: (a) acquiring a multiplicity of current profiles with repeated actuation of the fuel injector, wherein each current profile has a temporal progression of the current strength of a current flowing through the solenoid drive, and wherein each actuation of the fuel injector comprises the following steps: (aa) applying a boost voltage to the solenoid drive of the fuel injector until the current strength of the current flowing through the solenoid drive reaches a first predetermined value, (ab) waiting for the current strength to reach a second predetermined value during a first free-wheeling phase, (ac) applying the boost voltage to the solenoid drive again until the current strength reaches the first predetermined value, and (ad) waiting for the current strength to reach the second predetermined value during a second free-wheeling phase, wherein the first predetermined value is varied for each
(Continued)

actuation, the method also comprising (b) determining a multiplicity of magnetic flux profiles, wherein each magnetic flux profile corresponds to one of the multiplicity of acquired current profiles, and (c) selecting the reference current value on the basis of an analysis of the associated current profiles and magnetic flux profiles.

20 Claims, 3 Drawing Sheets

(52) U.S. Cl.
CPC ..... *F02D 2041/2041* (2013.01); *F02D 2041/2055* (2013.01); *F02D 2041/2058* (2013.01)

(58) Field of Classification Search
CPC ..... F02D 2041/2003; F02D 2041/2041; F02D 2041/2055; F02D 2041/2058; F02M 47/025; F02M 51/0653; F02M 51/0675; F02M 61/12; F02M 63/001
USPC ..... 123/478–481, 490; 701/103–105
See application file for complete search history.

(56) References Cited

U.S. PATENT DOCUMENTS

| | | | | |
|---|---|---|---|---|
| 2002/0097120 | A1 | 7/2002 | Butzmann et al. | |
| 2015/0184626 | A1 | 7/2015 | Denk | |
| 2015/0226148 | A1* | 8/2015 | Beer | F02D 41/247 123/480 |
| 2016/0102628 | A1 | 4/2016 | Denk | |
| 2016/0160784 | A1 | 6/2016 | Denk | |

FOREIGN PATENT DOCUMENTS

| | | | |
|---|---|---|---|
| DE | 102011075935 | A1 | 11/2012 |
| DE | 102012213883 | A1 | 2/2014 |
| DE | 102013207842 | A1 | 10/2014 |
| DE | 102013214412 | A1 | 1/2015 |
| EP | 1165944 | B1 | 5/2006 |

OTHER PUBLICATIONS

Office Action dated Feb. 16, 2016 of corresponding German patent application No. 10 2015 210 794.9.
English Abstract of DE 10 2011 075 935 A1.
English Abstract of DE 10 2010 063 009 A1.
Korean Office Action dated Oct. 24, 2018 for corresponding Korean application No. 10-2017-7035714.

* cited by examiner

METHOD FOR DETERMINING A REFERENCE CURRENT VALUE FOR ACTUATING A FUEL INJECTOR

The present invention relates to the technical field of the actuation of fuel injectors. It relates, in particular, to a method for determining a reference current value for actuating a fuel injector comprising a solenoid drive. The present invention also relates to a method for actuating a fuel injector, comprising a solenoid drive, for an internal combustion engine of a motor vehicle, to an engine controller and to a computer program.

During operation of fuel injectors with a solenoid drive (also referred to as coil injection injectors), electrical and mechanical tolerances result in different temporal opening behaviors of the individual injectors and therefore in variations in the respective injection quantity.

The relative differences in injection quantity from one injector to another become larger as the injection times become shorter. In the past, these relative differences in quantity were small and without practical significance. However, the development in the direction of smaller injection quantities and injection times means that the influence of the relative differences in quantity can no longer be ignored.

A specific temporal voltage profile or current profile is applied to the injectors for operation thereof. In particular, an increased voltage (boost voltage) is applied to an injector in order to open the injector. This voltage pulse is ended when the coil current reaches a specific reference current value (referred to as the peak current). However, at this time, the injector may already be open or not yet entirely open. This makes it difficult to achieve a predefined injection quantity precisely.

The temporal progression of the current strength during an opening process of the fuel injector (in which a voltage pulse (boost voltage) is applied to the solenoid drive) is dependent on the inductance of the solenoid drive. In addition to the changing intrinsic inductance of the solenoid drive (owing to the non-linear ferromagnetic material of the magnet), a proportion of movement inductance occurs as a result of the movement of the armature. The proportion of movement inductance starts at the beginning of the opening phase (armature movement/needle movement starts) and ends at the end of the opening phase (armature movement/needle movement ends).

The present invention is based on the object of making available an improved and simple method with which more precise actuation of fuel injectors is made possible by selecting a suitable reference current value.

This object is achieved by means of the subjects of the independent patent claims. Advantageous embodiments of the present invention are described in the dependent claims.

According to a first aspect of the invention, a method for determining a reference current value for actuating a fuel injector, comprising a solenoid drive, for an internal combustion engine of a motor vehicle is described. The described method comprises the following: (a) acquiring a multiplicity of current profiles with repeated actuation of the fuel injector, wherein each current profile has a temporal progression of the current strength of a current flowing through the solenoid drive, and wherein each actuation of the fuel injector comprises the following steps: (aa) applying a boost voltage to the solenoid drive of the fuel injector until the current strength of the current flowing through the solenoid drive reaches a first predetermined value, (ab) waiting for the current strength to reach the second predetermined value during a first free-wheeling phase, (ac) applying the boost voltage to the solenoid drive again until the current strength reaches the first predetermined value, and (ad) waiting for the current strength to reach the second predetermined value during a second free-wheeling phase, wherein the first predetermined value is varied for each actuation, the method also comprising (b) determining a multiplicity of magnetic flux profiles, wherein each magnetic flux profile corresponds to one of the multiplicity of acquired current profiles, and (c) selecting the reference current value on the basis of an analysis of the associated current profiles and magnetic flux profiles.

The described method is based on the realization that the relationship between the coil current and magnetic flux depends on whether the movable parts of the fuel injector (i.e. armature and needle) are moving or not. Therefore, by analyzing the current profiles and flux profiles it is possible to determine, e.g., whether the injector is already entirely open (no movement) or not (movement) in the first free-wheeling phase. This then permits qualified selection of the reference current value, with the result that the end of the opening process and the end of the boost phase can take place as close to one another as possible.

In this document, "reference current value" refers, in particular, to the value of the current strength of the current which flows through the solenoid drive and is used to end the boost phase when actuating a fuel injector in the operating mode. In other words, the boost voltage is switched off at the time at which the current strength reaches the reference current value. The reference current value is also referred to as the peak current.

In this document, the term "free-wheeling phase" denotes a phase in which no further electrical energy is fed to the solenoid drive, wherein the coil current will decrease over time.

With the described method, a series of actuations of the fuel injector is carried out, wherein the first predetermined value of the current strength is varied (for example increased incrementally), and wherein the boost voltage is applied twice to the solenoid drive. The two boost phases are separated by the first free-wheeling phase, and the first free-wheeling phase is followed by the second free-wheeling phase. At each actuation (i.e. for each value of the first predetermined value) the current strength is measured and sampled, with the result that the corresponding current profile is acquired. In this way, a multiplicity of current profiles is acquired, wherein each current profile corresponds to a first predetermined value of the current strength. Furthermore, a corresponding magnetic flux profile is determined for each current profile, that is to say the temporal progression of the magnetic flux is determined. Then, an analysis of all the associated current profiles and magnetic flux profiles is carried out, and on the basis thereof the suitable reference current value for the actuation of the fuel injector is selected.

The analysis of the current profiles and magnetic flux profiles can advantageously take place by forming a magnetic phase space in which associated values of magnetic flux and current strength are stored for each pair of current profiles and magnetic flux profiles. In other words, a phase space for each value of the first predetermined value is formed. Each point in such a magnetic phase space corresponds to a possible combination of current strength and magnetic flux, that is to say to a state of the physical system of the fuel injector.

According to one exemplary embodiment of the invention, the analysis of the associated current profiles and flux profiles comprises comparing a first relationship between the current strength and magnetic flux during the first free-wheeling phase with a second relationship between the current strength and the magnetic flux during the second free-wheeling phase.

In other words, the relationship between the current strength and the magnetic flux in the first free-wheeling phase is compared with the relationship between the current strength and the magnetic flux in the second free-wheeling phase. With respect to the magnetic phase space mentioned above this means that the part of the magnetic phase space which corresponds to the first free-wheeling phase is compared with the part of the magnetic phase space which corresponds to the second free-wheeling phase.

Therefore, it is possible to detect in an easy way whether or not movement is occurring in the first free-wheeling phase. In the first case, the first relationship (corresponds to the progression in the phase space) will differ from the second relationship, and in the second case it will not.

In other words, the opening process is already concluded before the start of the first free-wheeling phase if the first relationship does not differ from the second relationship. However, if the opening process only ends in the course of the first free-wheeling phase, the first relationship will differ from the second relationship.

According to a further exemplary embodiment of the invention, the selection of the reference current value comprises selecting the lowest value of the first predetermined value at which the first relationship is essentially the same as the second relationship.

In other words, in this exemplary embodiment the lowest value of the first predetermined value at which there is no movement during the first free-wheeling phase is selected as a reference current value. Therefore, the time of the ending of the opening process and the time of the ending of the boost phase are positioned very close to one another.

According to a further exemplary embodiment of the invention, the determination of a multiplicity of magnetic flux profiles is carried out by calculations on the basis of the current strength, voltage and electrical resistance of the solenoid drive.

The voltage U is preferably measured, sampled and stored together with the current strength I. The electrical resistance R of the solenoid drive, that is to say the coil resistance, is assumed to be known. The temporal progression of the magnetic flux $\phi$ can then also be calculated from these values (as functions of the time) by solving the known differential equation $$U = RI + N\frac{d\phi}{dt}$$

where N is the number of coil windings.

According to a further exemplary embodiment of the invention, the method also comprises determining an opening time of the fuel injector for one of the acquired current profiles on the basis of an analysis of the current profile and of the corresponding magnetic flux profile.

In this exemplary embodiment, a current profile and the associated magnetic flux profile are analyzed in order to determine the opening time of the fuel injector. Through knowledge of the precise opening time it is, under certain circumstances, possible to adapt the actuation of the fuel injector.

According to a further exemplary embodiment of the invention, the analysis of the current profile and of the corresponding flux profile comprises determining an associated pair of current strength and magnetic flux in which a first relationship between the current strength and the magnetic flux during the first free-wheeling phase differs from a second relationship between the current strength and the magnetic flux during the second free-wheeling phase.

In other words, a point in the magnetic phase space is determined at which the progression during the first free-wheeling phase separates from the progression during the second free-wheeling phase.

According to a second aspect of the invention, a method for actuating a fuel injector, comprising a solenoid drive, for an internal combustion engine of a motor vehicle is described. The described method comprises the following: (a) determining a reference current value by carrying out the method according to the first aspect or as claimed in one of the preceding claims, and (b) applying a boost voltage to the solenoid drive of the fuel injector until the current strength of the current flowing through the solenoid drive reaches the determined reference current value.

In this aspect of the invention, the method according to the first aspect and/or the above-described exemplary embodiments is used to determine the optimum peak current, with the result that the end of the boost phase occurs as close as possible to the end of the opening process. In other words, a reference current value (peak current) is first determined. This can take place during normal operation. The determined reference current value is then used during the actuation of the fuel injector.

According to a third aspect of the invention, an engine controller for a vehicle is described, which engine controller is configured to use a method according to the first or second aspect and/or one of the above exemplary embodiments.

This engine controller permits precise and balanced injection to be achieved in an easy way.

According to a fourth aspect of the invention, a computer program is described, which is configured, when executed by a processor, to carry out the method according to the first or second aspect and/or one of the above exemplary embodiments.

According to this document, the designation of such a computer program is equivalent to the concept of a program element, computer program product and/or computer-readable medium which contains instructions for controlling a computer system in order to coordinate the mode of operation of a system or of a method in a suitable way, in order to achieve the effects linked to the method according to the invention.

The computer program can be implemented as computer-readable instruction code in any suitable programming language such as, for example, in JAVA, C++, etc. The computer program can be stored on a computer-readable storage medium (CD-ROM, DVD, Blu-ray disk, removable drive, volatile or non-volatile memory, built-in memory/processor etc.). The instruction code can program a computer or other programmable devices such as, in particular, a control unit for an engine of a motor vehicle in such a way that the desired functions are executed. In addition, the computer program can be made available in a network such as, for example, the Internet, from which it can be downloaded by a user when necessary.

The invention can be implemented either by means of a computer program, i.e. a software package, or by means of one or more specific electrical circuits, i.e. using hardware or in any desired hybrid form, i.e. by means of software components and hardware components.

It is to be noted that embodiments of the invention have been described with respect to different inventive subjects. In particular, some embodiments of the invention are described with method claims and other embodiments of the invention with device claims. However, it will become immediately clear to a person skilled in the art on reading this application that, unless explicitly specified otherwise, in addition to a combination of features which are associated with one type of inventive subject any desired combination of features which are associated with different types of inventive subjects is possible.

Further advantages and features of the present invention derive from the following exemplary description of a preferred embodiment.

It is to be noted that the embodiments described below constitute merely a restricted selection of possible embodiment variants of the invention.

Figure 1:
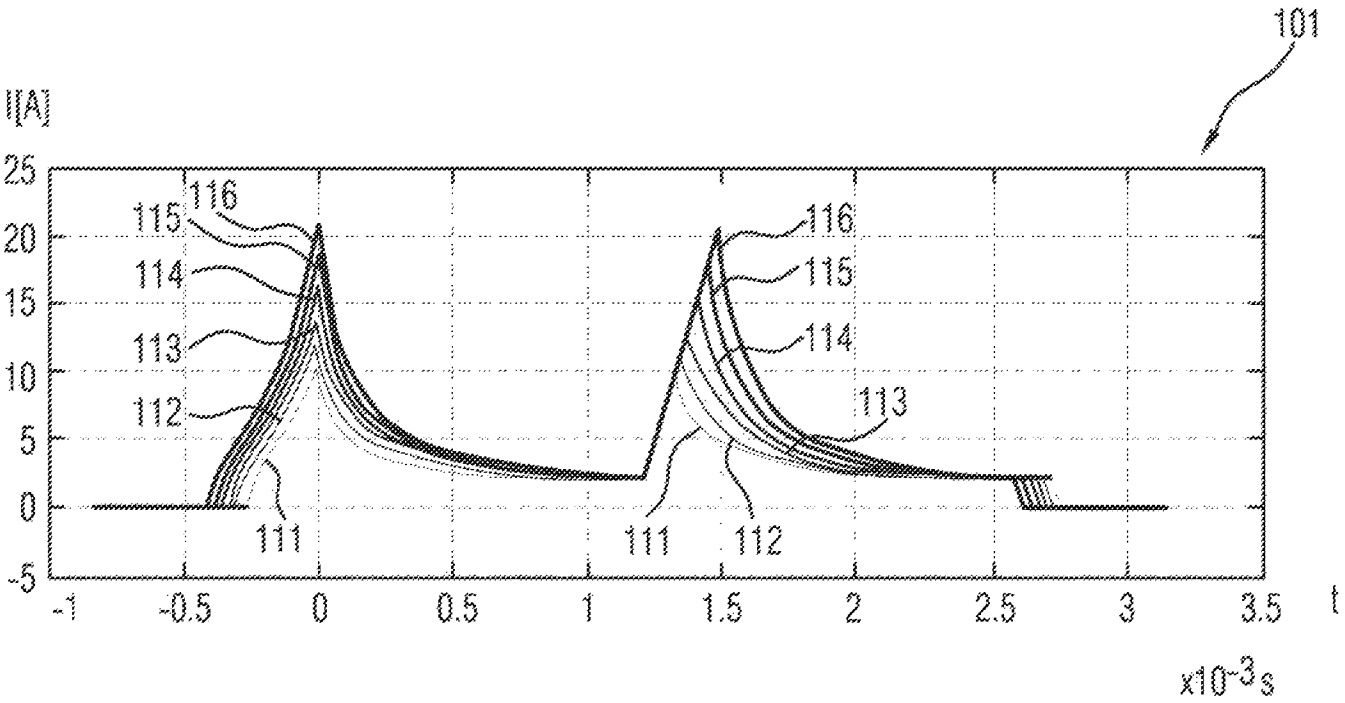
FIG. 1 shows a graphic illustration of a multiplicity of current profiles which are used according to the invention to determine a reference current value.

FIG. 1 shows a graphic illustration 101 of a multiplicity of current profiles 111 to 116 which are used according to the invention to determine a reference current value. The current profiles 111 to 116 are arranged in the illustration 101 in such a way that they all reach their first maximum value (or first predetermined value) at the time t=0.

Each current profile 111 to 116 is adopted according to the invention by the engine control unit in such a way that a boost voltage (i.e. a voltage of e.g. 40 V to 60 V which is increased compared to the on-board power system voltage) is first applied to the solenoid drive of a fuel injector. The current strength of the current flowing through the solenoid drive is measured, sampled and stored by the control unit. If the current strength reaches a first predetermined value (peak current of the profile), the boost voltage is switched off and the fuel injector passes into a first free-wheeling phase in which no further electrical energy is supplied. This leads to a situation in which the current strength decreases with time. If the current strength reaches a second predetermined value, the first free-wheeling phase is ended and the boost voltage is applied to the solenoid drive again, with the result that the current strength rises again. If the current strength then reaches the first predetermined value again, the boost voltage is switched off again and a second free-wheeling phase follows until the current strength reaches the second predetermined value again. This is followed by a holding phase in which the fuel injector is held open until the start of the closing process, by applying a holding voltage thereto, until the desired injection quantity is reached.

Each individual current profile 111 to 116 is, in other words, produced by applying a second boost phase. Therefore, each current profile also has two free-wheeling phases. By comparing these two free-wheeling phases, it is then possible, as described in more detail below, to derive valuable information relating to the opening time of the fuel injector. The current profiles 111 to 116 can advantageously be acquired during the normal operation of the fuel injector.

The six current profiles 111 to 116 shown in FIG. 1 differ, in particular, in that the predetermined value of the current strength at which the boost phases are ended, is selected differently for each current profile 111 to 116. This, of course, also influences the duration of the boost phases. For the current profile 111 the first predetermined value is approximately 10 A, for the current profile 112 the first predetermined value is approximately 12 A, for the current profile 113 the first predetermined value is approximately 14 A, for the current profile 114 the first predetermined value is approximately 16 A, for the current profile 115 the first predetermined value is approximately 128, and for the current profile 116 the first predetermined value is approximately 20 A.

Figure 2:
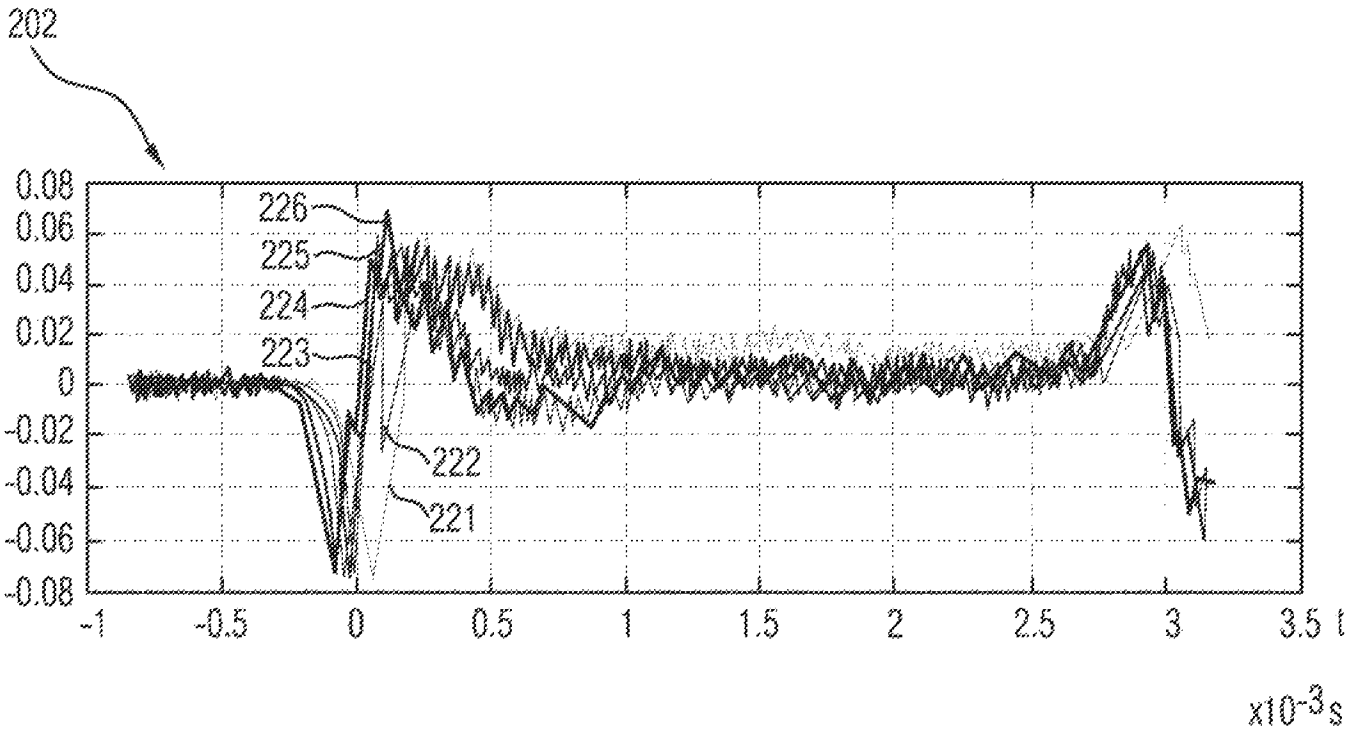
FIG. 2 shows a graphic illustration of a multiplicity of sound signals which correspond to the current profiles shown in FIG. 1.

FIG. 2 shows a graphic illustration 202 of a multiplicity of sound signals 221 to 226 from an acoustic sensor on the fuel injector, which sound signals correspond to the current profiles 111 to 116 shown in FIG. 1. To be more precise, the sound signal 221 corresponds to the current profile 111 shown in FIG. 1, the sound signal 222 corresponds to the current profile 112 shown in FIG. 1, the sound signal 223 corresponds to the current profile 113 shown in FIG. 1, the sound signal 224 corresponds to the current profile 114 shown in FIG. 1, the sound signal 225 corresponds to the current profile 115 shown in FIG. 1, and the sound signal 226 corresponds to the current profile 116 shown in FIG. 1.

The acoustic sensor is mounted in such a way that it can sense the acoustic sounds which are produced by movements in the fuel injector, for example when the armature impacts at the end of the opening process. From illustration 202 it is apparent that the end of the opening process occurs earlier for current profiles with a high first predetermined value and later for current profiles with a lower first predetermined value. In particular, the curves 226, 225 and 224 show that the end of the opening process for the corresponding current profiles 116, 115 and 114 occurs before the end of the first boost phase (t=0). Furthermore, the curves 222 and 221 show that the end of the opening process for the corresponding current profiles 112 and 111 occurs after the end of the first boost phase (t=0). However, for the curve 223 the end of the opening process coincides essentially with the end of the first boost phase (t=0), with the result that actuation of the fuel injector with a peak current value equal to the first predetermined value for the current profile 113 would give rise to a situation in which the end of the opening process occurs chronologically very close to the end of the corresponding boost phase.

The illustration in FIG. 2 is based on laboratory measurements in which an acoustic sensor has been specifically used. It serves merely for the purpose of illustration and is not as such part of the method according to the invention.

Figure 3:
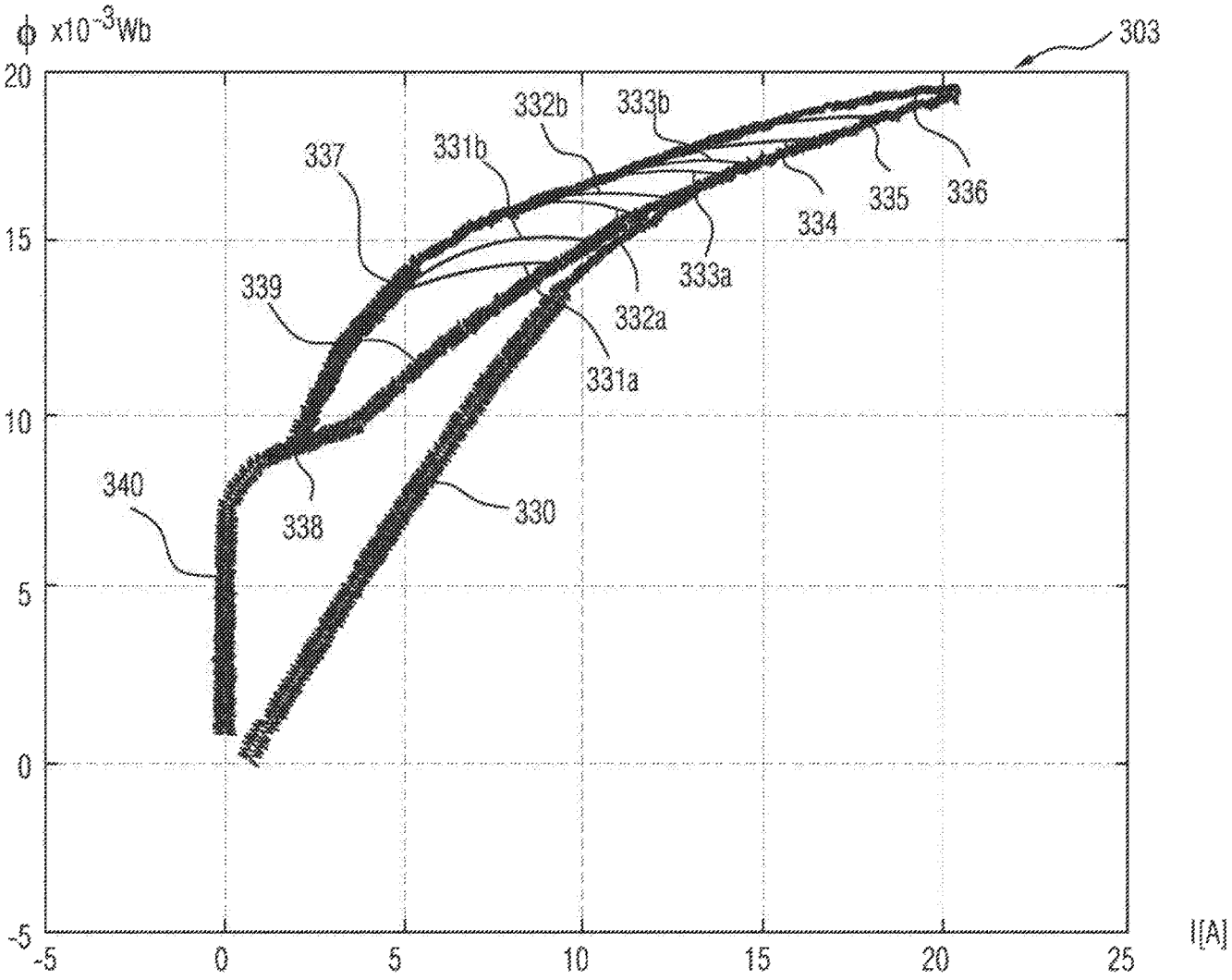
FIG. 3 shows a graphic illustration of a magnetic phase space corresponding to the current profiles shown in FIG. 1.

FIG. 3 shows a graphic illustration 303 of a magnetic phase space, that is to say a relationship between the magnetic flux $\phi$ and the current strength I, decoupled from time, corresponding to the current profiles 111 to 116 shown in FIG. 1. The magnetic flux is preferably calculated by the control unit on the basis of the respective current profile, voltage profile and coil resistance.

The relationship between the magnetic flux and the coil current is explained in more detail first with reference to the current profile 111 in FIG. 1. Before the start of the first boost phase, the magnetic flux is 0 mWb and the coil current is 0 A. The first rise in current of the current profile 111 (from t≈−0.3 ms to t=0 ms) in FIG. 1 runs along the curve section 330 in FIG. 3. In the case of a current strength of just above 10 A the boost voltage is switched off and both the current strength and the magnetic flux now drop along the curve sections 331*a* and 337 up to the point 338, which corresponds to the end of the first free-wheeling phase. The subsequent rise in current in the second boost phase then runs along the curve section 339 until the current strength of just above 10 A is reached again at the end of the second boost phase. The subsequent second free-wheeling phase then runs along the curve sections 331*b* (at which the magnetic flux is somewhat larger than at the curve section 331*a*) and 337 and ends again at the point 338. Finally, the closing of the fuel injector runs along the curve section 340.

As can be inferred from FIG. 3, it is the case for the current profile 111 in FIG. 1 that the relationship (first relationship) between the current and the magnetic flux during the first free-wheeling phase (curve section 331*a*) is not the same as the relationship (second relationship) between the current and the magnetic flux during the second free-wheeling phase (curve section 331*b*). This can be attributed to the fact that, as has also been explained above in conjunction with FIG. 2, the opening process is not yet completed before the start of the first free-wheeling phase. In other words, movement is still occurring in the fuel injector during the course of the first free-wheeling phase.

A similar behavior can be observed in FIG. 3 for the current profiles 112 and 113 in FIG. 1, as has just been discussed with reference to the current profile 111. More specifically, a first relationship between the magnetic flux and the current can be seen along the curve sections 332*a* and 333*a*, and a second relationship between the magnetic flux and the current can be seen along the curve sections 332*b* and 333*b*.

No difference between the free-wheeling phases can be seen any more for the current profiles 114, 115 and 116 in FIG. 1. More specifically, the relationship between the magnetic flux and the current in both free-wheeling phases is essentially the same. For the current profile 114 both free-wheeling phases run along curve sections 334 and 337, for the current profile 115 both free-wheeling phases run along the curve sections 335 and 337, and for the current profile 116 both free-wheeling phases run along the curve sections 336 and 337.

According to the invention, the engine controller consequently selects the first predetermined value of the current profile 114, that is to say 16 A, as a peak current for the actuation of the fuel injector, in order to position the end of the boost phase as close as possible to the end of the opening process. The injection quantity can be controlled very precisely by this synchronization of the boost phase and the opening process.

Furthermore, the engine controller can determine the precise time at which the opening process ends for each individual current profile 111 to 113. More specifically, the engine controller determines the point in the magnetic phase space at which the different curve sections 331*a/b*, 332*a/b* and 333*a/b* merge together again and are connected to the common curve section 337. The time in the corresponding current profile which corresponds to the current strength at this point in the magnetic phase space within the first free-wheeling phase is then the searched-for opening time.

Moreover, the engine controller can determine, for each individual current profile 111 to 116, the work or stroke work which is performed during the opening process. This can be done by integration in the phase space along the curve sections of the first free-wheeling phase and along the curve sections of the second free-wheeling phase and by subtracting these two integration values. With knowledge of the spring constant of the solenoid drive it is then possible to determine the stroke of the fuel injector.

In summary, the method according to the invention permits in an easy way and without the use of further hardware (such as, for example, acoustic sensors or acceleration sensors) actuation of a fuel injector in which the end of the opening process and the end of the boost phase (essentially) coincide chronologically. Furthermore, an opening time and stroke work which has been performed can be determined for a selected or single current profile on the basis of the measurement data recorded in accordance with the method.

LIST OF REFERENCE NUMBERS

101 Graphic illustration of current profiles
111 Current profile
112 Current profile
113 Current profile
114 Current profile
115 Current profile
116 Current profile
202 Graphic illustration of sound signals
221 Sound signal
222 Sound signal
223 Sound signal
224 Sound signal
225 Sound signal
226 Sound signal
303 Graphic illustration of magnetic phase space
330 Curve section
331*a* Curve section
331*b* Curve section
332*a* Curve section
332*b* Curve section
333*a* Curve section
333*b* Curve section
334 Curve section
335 Curve section
336 Curve section
337 Curve section
338 Holding state
339 Curve section
340 Curve section

The invention claimed is:

1. A method for actuating a fuel injector comprising a solenoid drive, for an internal combustion engine of a motor vehicle, the method comprising:

acquiring a plurality of current profiles with repeated actuation of the fuel injector, wherein each current profile has a temporal progression of a current strength of a current flowing through the solenoid drive, and wherein each actuation of the fuel injector comprises:

applying a first boost voltage to the solenoid drive of the fuel injector until the current strength of the current flowing through the solenoid drive reaches a first predetermined value;

waiting for the current strength of the current flowing through the solenoid drive to reach a second predetermined value during a first free-wheeling phase;

applying a second boost voltage to the solenoid drive until the current strength of the current flowing through the solenoid drive reaches the first predetermined value; and waiting for the current strength of the current flowing through the solenoid drive to reach the second predetermined value during a second free-wheeling phase;

wherein the first predetermined value is varied for each actuation, the method also comprises:

determining a plurality of magnetic flux profiles, wherein each magnetic flux profile corresponds to one of the plurality of acquired current profiles, and selecting a reference current value on the basis of an analysis of the current profiles and the magnetic flux profiles.

2. The method of claim 1, wherein the analysis of the associated current profiles and the flux profiles comprises: comparing a first relationship between the current strength and the magnetic flux during the first free-wheeling phase with a second relationship between the current strength and the magnetic flux during the second free-wheeling phase.

3. The method of claim 2, wherein selecting the reference current value comprises selecting a lowest value of the first predetermined value at which the first relationship is essentially the same as the second relationship.

4. The method of claim 1, wherein determining the plurality of magnetic flux profiles is carried out by calculations on the basis of the current strength, voltage and electrical resistance of the solenoid drive.

5. The method of claim 1, further comprising determining an opening time of the fuel injector for one of the current profiles on the basis of an analysis of the one current profile and the magnetic flux profile corresponding thereto.

6. The method of claim 5, wherein the analysis of the one current profile and of the corresponding flux profile comprises determining an associated pair of current strength and magnetic flux, in which a first relationship between the current strength and the magnetic flux during a first free-wheeling phase differs from a second relationship between the current strength and the magnetic flux during a second free-wheeling phase.

7. The method of claim 1, further comprising:

following selecting a reference current, applying a third boost voltage to the solenoid drive of the fuel injector until the current strength of the current flowing through the solenoid drive reaches the determined reference current value.

8. The method of claim 1, wherein waiting for the current strength of the current through the solenoid drive to reach a second predetermined value during a first free-wheeling phase occurs upon the current strength reaching the first predetermined value;

applying a second boost voltage to the solenoid drive until the current strength reaches the first predetermined value occurs upon the current strength reaching the second predetermined value; and waiting for the current strength to reach the second predetermined value during a second free-wheeling phase occurs upon the current strength reaching the first predetermined value.

9. A computer program product stored on a non-transitory memory and having instructions which, when executed by a control unit for an engine of a motor vehicle having a fuel injector with a solenoid drive, causes the control unit to:

acquire a plurality of current profiles with repeated actuations of the fuel injector, wherein each current profile has a temporal progression of a current strength flowing through the solenoid drive, and wherein each actuation of the fuel injector comprises:

apply a first boost voltage to the solenoid drive of the fuel injector until the current strength flowing through the solenoid drive reaches a first predetermined value;

upon the current strength reaching the first predetermined value, wait for the current strength of the current through the solenoid drive to reach a second predetermined value during a first free-wheeling phase;

upon the current strength of the current through the solenoid drive reaching the second predetermined value, apply a second boost voltage to the solenoid drive until the current strength reaches the first predetermined value; and upon the current strength reaching the first predetermined value, wait for the current strength to reach the second predetermined value during a second free-wheeling phase;

wherein the first predetermined value is varied for each actuation, determine a plurality of magnetic flux profiles, wherein each magnetic flux profile corresponds to a distinct one of the plurality of acquired current profiles, and select a reference current value based on the current profiles and the magnetic flux profiles.

10. The computer program product of claim 9, wherein the instructions for selecting the reference current value select a lowest value of the first predetermined value at which the first relationship is essentially the same as the second relationship.

11. The computer program product of claim 9, wherein the instructions for determining the magnetic flux profiles determines the magnetic flux profile is based upon the current strength, voltage and electrical resistance of the solenoid drive.

12. The computer program product of claim 9, further comprising instructions for determining an opening time of the fuel injector for one of the current profiles based on the one current profile and the magnetic flux profile corresponding thereto.

13. The computer program product of claim 9, further comprising instructions for determining an associated pair of current strength and magnetic flux, in which a first relationship between the current strength and the magnetic flux during a first free-wheeling phase differs from a second relationship between the current strength and the magnetic flux during a second free-wheeling phase.

14. The computer program product of claim 9, further comprising instructions for, following the reference current being selected, applying a third boost voltage to the solenoid drive of the fuel injector until the current strength of the current flowing through the solenoid drive reaches the determined reference current value.

15. A controller for an engine of a motor vehicle, the engine including a fuel injector, the controller configured to:

acquire a plurality of current profiles with repeated actuations of the fuel injector, wherein each current profile has a temporal progression of a current strength flowing through the solenoid drive, and wherein each actuation of the fuel injector comprises:

apply a first boost voltage to the solenoid drive of the fuel injector until the current strength flowing through the solenoid drive reaches a first predetermined value;

upon the current strength reaching the first predetermined value, wait for the current strength of the current through the solenoid drive to reach a second predetermined value during a first free-wheeling phase;

upon the current strength reaching the second predetermined value, apply a second boost voltage to the solenoid drive until the current strength reaches the first predetermined value; and upon the current strength reaching the first predetermined value, wait for the current strength to reach the second predetermined value during a second free-wheeling phase;

wherein the first predetermined value is varied for each actuation, determine a plurality of magnetic flux profiles, wherein each magnetic flux profile corresponds to one of the plurality of acquired current profiles, and select a reference current value based on the current profiles and the magnetic flux profiles.

16. The controller of claim 15, wherein selection of the reference current value comprises selecting a lowest value of the first predetermined value at which the first relationship is essentially the same as the second relationship.

17. The controller of claim 16, wherein determining the magnetic flux profiles is based upon the current strength, voltage and electrical resistance of the solenoid drive.

18. The controller of claim 15, wherein the controller is further configured to determine an opening time of the fuel injector for one of the current profiles based on the one current profile and the magnetic flux profile corresponding thereto.

19. The controller of claim 15, wherein controller is further configured to determine an associated pair of current strength and magnetic flux, in which a first relationship between the current strength and the magnetic flux during a first free-wheeling phase differs from a second relationship between the current strength and the magnetic flux during a second free-wheeling phase.

20. The controller of claim 15, wherein the controller is further configured to, following the reference current being selected, apply a third boost voltage to the solenoid drive of the fuel injector until the current strength of the current flowing through the solenoid drive reaches the determined reference current value.

* * * * *